US007044709B2

(12) United States Patent
Bruce et al.

(10) Patent No.: US 7,044,709 B2
(45) Date of Patent: May 16, 2006

(54) METHODS AND APPARATUS FOR COUPLING CERAMIC MATRIX COMPOSITE TURBINE COMPONENTS

(75) Inventors: Kevin Leon Bruce, Greer, SC (US); David Vincent Bucci, Simpsonville, SC (US); Ronald Ralph Cairo, Greer, SC (US); David Mitchell, Longwood, FL (US)

(73) Assignee: General Electric Company, Schenectady, NY (US)

( * ) Notice: Subject to any disclaimer, the term of this patent is extended or adjusted under 35 U.S.C. 154(b) by 107 days.

(21) Appl. No.: 10/758,553

(22) Filed: Jan. 15, 2004

(65) Prior Publication Data

US 2005/0158168 A1 Jul. 21, 2005

(51) Int. Cl.
*F01D 11/08* (2006.01)

(52) U.S. Cl. ..... 415/173.1; 415/173.3; 415/135

(58) Field of Classification Search ..... 415/135, 415/136, 138, 139, 173.1, 173.3, 173.6, 174.2
See application file for complete search history.

(56) References Cited

U.S. PATENT DOCUMENTS

| | | | | |
|---|---|---|---|---|
| 3,695,778 | A | 10/1972 | Taylor | |
| 4,236,870 | A | 12/1980 | Hucul, Jr. et al. | |
| 4,416,585 | A | 11/1983 | Abdel-Messeh | |
| 5,292,230 | A | 3/1994 | Brown | |
| 5,507,621 | A | 4/1996 | Cooper | |
| 5,741,117 | A | 4/1998 | Clevenger et al. | |
| 5,951,256 | A | 9/1999 | Dietrich | |
| 6,045,310 | A * | 4/2000 | Miller et al. | 411/383 |
| 6,132,169 | A | 10/2000 | Manning et al. | |
| 6,186,741 | B1 | 2/2001 | Webb et al. | |
| 6,821,085 | B1 * | 11/2004 | Darkins et al. | 415/173.1 |

* cited by examiner

*Primary Examiner*—Edward K. Look
*Assistant Examiner*—Dwayne J White
(74) *Attorney, Agent, or Firm*—Armstrong Teasdale LLP

(57) ABSTRACT

A method facilitates assembling a stator assembly for a turbine engine. The method comprises positioning a shroud fabricated from a ceramic matrix composite material adjacent a metallic stator block, and coupling the shroud to the stator block using a coupling arrangement such that a predetermined radial clearance is defined between the shroud and a rotor assembly coupled radially inward thereof.

48 Claims, 4 Drawing Sheets

METHODS AND APPARATUS FOR COUPLING CERAMIC MATRIX COMPOSITE TURBINE COMPONENTS

BACKGROUND OF THE INVENTION

This application relates generally to turbine engines and, more particularly, to methods and apparatus for assembling turbine engine components that are fabricated from ceramic matrix composite materials.

Turbine engines include at least one stator assembly and at least one rotor assembly. At least some known rotor assemblies include at least one row of circumferentially-spaced rotor blades. The blades extend radially outward from a platform to a tip. A plurality of static shrouds coupled to a stator block abut together to form flowpath casing that extends circumferentially around the rotor blade assembly, such that a radial tip clearance is defined between each respective rotor blade tip and the casing or shroud. The tip clearance is tailored to be a minimum, yet is sized large enough to facilitate rub-free engine operation through the range of available engine operating conditions.

During operation, tip leakage across the rotor blade tips may limit the performance and stability of the rotor assembly. However, during operation, because the shrouds may be subjected to higher operating temperatures than the stator block, the shrouds may thermally expand at a different rate than the stator block or the fastener assemblies used to couple the shrouds to the stator block. More specifically, the differential thermal expansion may undesirably cause increased tip leakage as the operating temperature within the engine is increased. In addition, over time, the heat transfer from the shrouds and the differential thermal expansion may also cause premature failure of the fastener assemblies.

Accordingly, to facilitate reducing tip leakage caused by the differential thermal expansion, at least some known engines supply increased cooling flow past the shrouds and fastener assemblies. However, excessive cooling flow may adversely affect engine performance. To facilitate increasing the operating temperature of the engine, and thus facilitate improving engine performance, other known stator assemblies have included shrouds fabricated from stronger or higher temperature capability materials. However, although such materials should enable the shrouds to be exposed to higher operating temperatures, the operation of the engine may still be limited by the increased thermal differential expansion rates between the shrouds and the stator block through the fastener assemblies.

BRIEF DESCRIPTION OF THE INVENTION

In one aspect, a method for assembling a stator assembly for a turbine engine is provided. The method comprises positioning a shroud fabricated from a ceramic matrix composite material adjacent to a metallic stator block, and coupling the shroud to the stator block using a coupling arrangement such that a predetermined radial clearance is defined between the shroud and a rotor assembly coupled radially inward thereof.

In another aspect, a stator assembly for a turbine engine is provided. The stator assembly includes a stator block including at least one fastener opening, a coupling arrangement, and a shroud coupled to the stator block by the coupling arrangement. The shroud includes at least one fastener opening. The coupling arrangement includes at least one fastener extending through the shroud at least one fastener opening and at least one fastener opening through the stator block. The fastener includes an external surface coated with at least one of a wear coating and a thermal barrier coating.

In a further aspect, a turbine engine is provided. The turbine engine includes a rotor assembly, and a stator assembly that includes a stator block, at least one fastener, and a shroud. The shroud is coupled to the stator block by the at least one fastener such that a radial clearance is defined between at least a portion of the rotor assembly and the shroud. The at least one fastener includes an external surface coated with at least one of a wear coating and a thermal barrier coating.

DETAILED DESCRIPTION OF THE INVENTION

Figure 1:
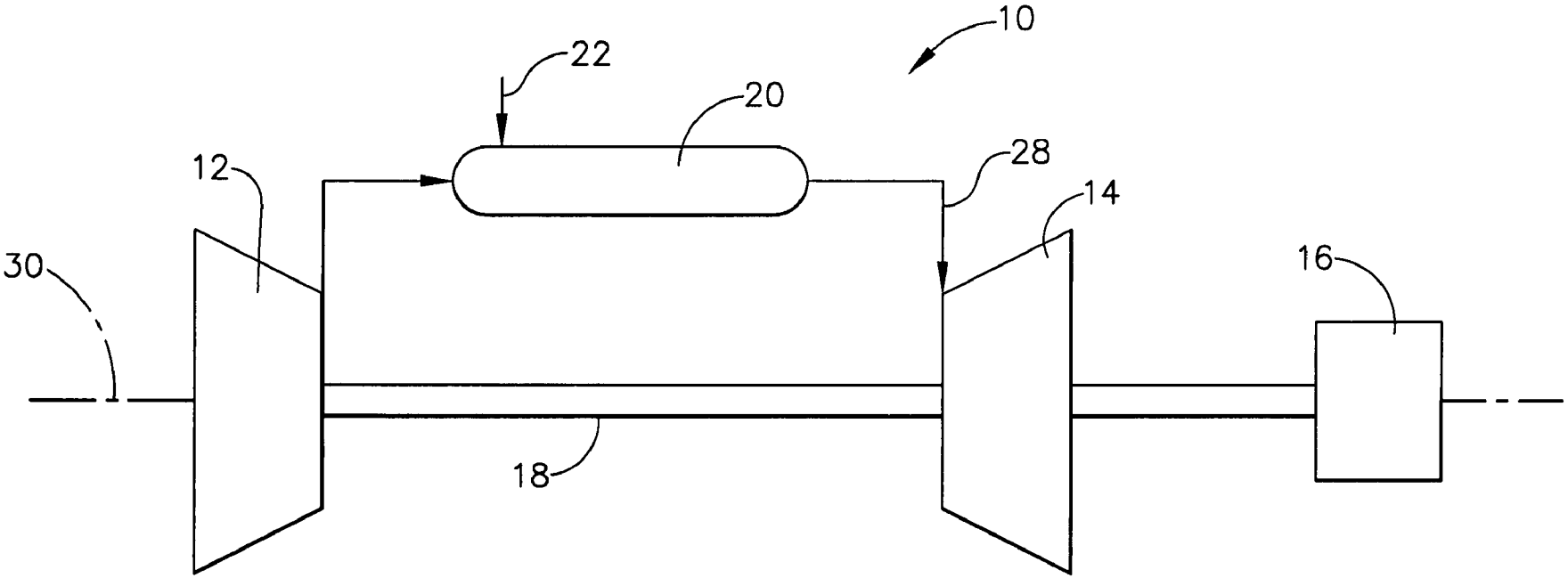
FIG. 1 is a schematic illustration of an exemplary gas turbine engine.

FIG. 1 is a schematic illustration of an exemplary gas turbine engine 10 coupled to an electric generator 16. In the exemplary embodiment, gas turbine system 10 includes a compressor 12, a turbine 14, and generator 16 arranged in a single monolithic rotor or shaft 18. In an alternative embodiment, shaft 18 is segmented into a plurality of shaft segments, wherein each shaft segment is coupled to an adjacent shaft segment to form shaft 18. Compressor 12 supplies compressed air to a combustor 20 wherein the air is mixed with fuel supplied via a stream 22. In one embodiment, engine 10 is a 6FA+e gas turbine engine commercially available from General Electric Company, Greenville, S.C.

In operation, air flows through compressor 12 and compressed air is supplied to combustor 20. Combustion gases 28 from combustor 20 propels turbines 14. Turbine 14 rotates shaft 18, compressor 12, and electric generator 16 about a longitudinal axis 30.

Figure 2:
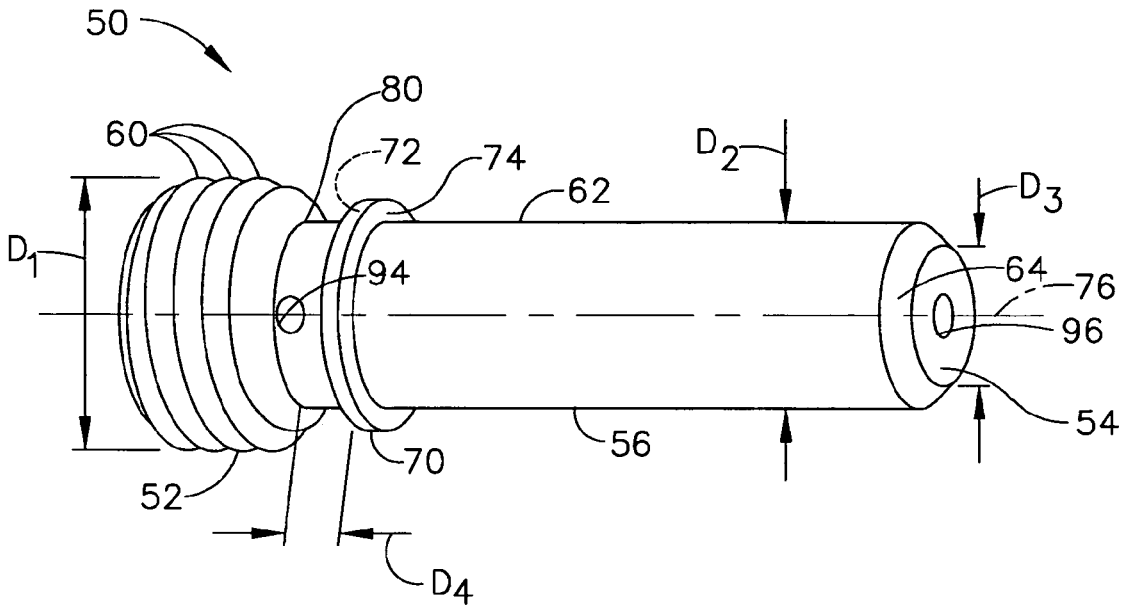
FIG. 2 is an enlarged side view of an exemplary fastener that may be used with a turbine engine, such as the gas turbine engine shown in FIG. 1.
Figure 3:
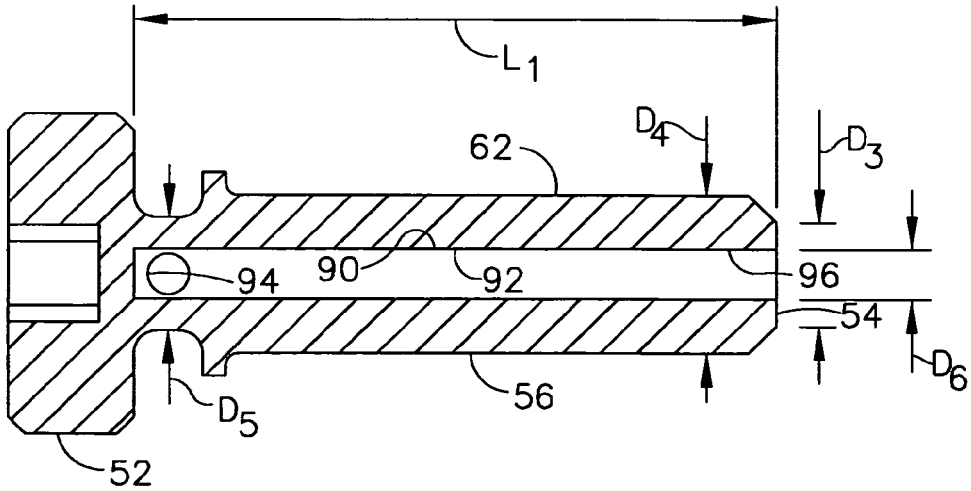
FIG. 3 is a cross-sectional view of the fastener shown in FIG. 2.

FIG. 2 is an enlarged side view of an exemplary fastener 50 that may be used with a turbine engine, such as engine 10 (shown in FIG. 1). FIG. 3 is a cross-sectional view of fastener 50. In the exemplary embodiment, fastener 50 is a pin, and includes an integrally-formed head portion 52, a nose portion 54, and a barrel or shank portion 56 extending therebetween. In the exemplary embodiment, head portion 52 is threaded and has a diameter $D_1$ that is larger than a diameter $D_2$ of barrel portion 56. More specifically, in the exemplary embodiment, head portion 52 is formed with a plurality of threads 60 extending outwardly from an external surface 62 of fastener 50. Threads 60 enable fastener 50 to be secured within a threaded opening (not shown in FIGS. 2 and 3). In an alternative embodiment, head portion 52 does not include any threads 60, but rather barrel portion 56 is threaded.

In the exemplary embodiment barrel portion diameter $D_2$ is substantially constant between head and nose portions 52 and 54, respectively. Moreover, in the exemplary embodiment, barrel portion 56 is un-threaded such that fastener external surface 62 is substantially smooth across portion 56. In an alternative embodiment, at least a portion of barrel portion 56 is threaded. In another alternative embodiment, barrel portion diameter $D_2$ is not constant across barrel portion 56. In the exemplary embodiment, barrel portion diameter $D_2$ is between approximately 0.25 inches and 0.3125 inches.

Nose portion 54 is gradually tapered inward from barrel portion 56 such that a diameter $D_3$ at an inner end 64 of fastener 50 is smaller than barrel portion diameter $D_2$. Moreover, in the exemplary embodiment, nose portion 54 curves inwardly such that portion 54 has a bullnose-shaped cross-sectional profile.

A sealing flange 70 extends radially outward from barrel portion 56 such that a pair of opposed faces 72 and 74 are defined. In the exemplary embodiment, faces 72 and 74 are substantially parallel and each is substantially perpendicular to a centerline axis of symmetry 76 extending through fastener 50. Moreover, in the exemplary embodiment, sealing flange 70 is formed integrally with fastener 50. In an alternative embodiment, fastener 50 does not include a sealing flange 70.

Sealing flange 70 is spaced a distance $d_4$ from head portion 52 such that an annulus 80 is defined between sealing flange 70 and head portion 52. In the exemplary embodiment, annulus 80 has an external diameter $D_5$ that is smaller than barrel portion diameter $D_2$ and is substantially constant therethrough.

A cooling passageway 90 is defined within fastener 50 and extends through barrel and nose portions 56 and 54, respectively. Cooling passageway 90 has a diameter $D_6$ measured with respect to an inner surface 92 of fastener 50. In the exemplary embodiment, diameter $D_6$ is substantially constant along a length $L_1$ of passageway 90.

Cooling passageway 90 extends from an inlet 94 to a discharge outlet 96. Inlet 94 extends generally radially from fastener external surface 62 to passageway 90 and enables cooling fluid to be supplied to fastener passageway 90 from a cooling circuit (not shown in FIGS. 2 and 3) when fastener 50 is secured within the threaded opening. More specifically, in the exemplary embodiment, inlet 92 is defined within annulus 80. Outlet 96 extends substantially axially from fastener external surface 62 to passageway 90 and enables cooling fluid to be discharged from fastener passageway 90 when fastener 50 is secured within the threaded opening. More specifically, in the exemplary embodiment, outlet 96 is substantially concentrically aligned with respect to fastener 50, and extends axially inward from fastener end 64.

Fastener external surface 62 is coated with a wear coating and/or a thermal barrier coating (TBC) that facilitates improving the wear characteristics of fastener 50 and/or thermally insulates fastener 50, as described in more detail below. For example, in one embodiment, fastener 50 is fabricated from a metallic alloy material, such as L605, commercially available from Haynes International, Inc., Kokomo, Ind. More specifically, fasteners 50 are fabricated from metallic materials which facilitate fasteners 50 operating with a desired fracture toughness, and a demonstrated reliability.

Moreover, in at least some embodiments, the coating also facilitates reducing oxidation of fastener 50. For example, in the exemplary embodiment, fastener 50 is coated with a wear or thermally insulating bond coat, such as a NiCrAlY, and is then further coated with an external oxidation resistive coating, such as Deloro-Stellite's Tribaloy T-800. The gradual transition of nose portion 54 facilitates enhancing the coating adhesion to fastener 50, as more radical transitions may result in loss of coating during, or shortly after, the coating process. Accordingly, as described in more detail below, the fastener coating enables fastener 50 to be utilized in increased stress environments and/or in increased operating temperatures, without requiring that fasteners 50 be fabricated from more expensive or brittle materials that are more temperature or wear resistive.

Figure 4:
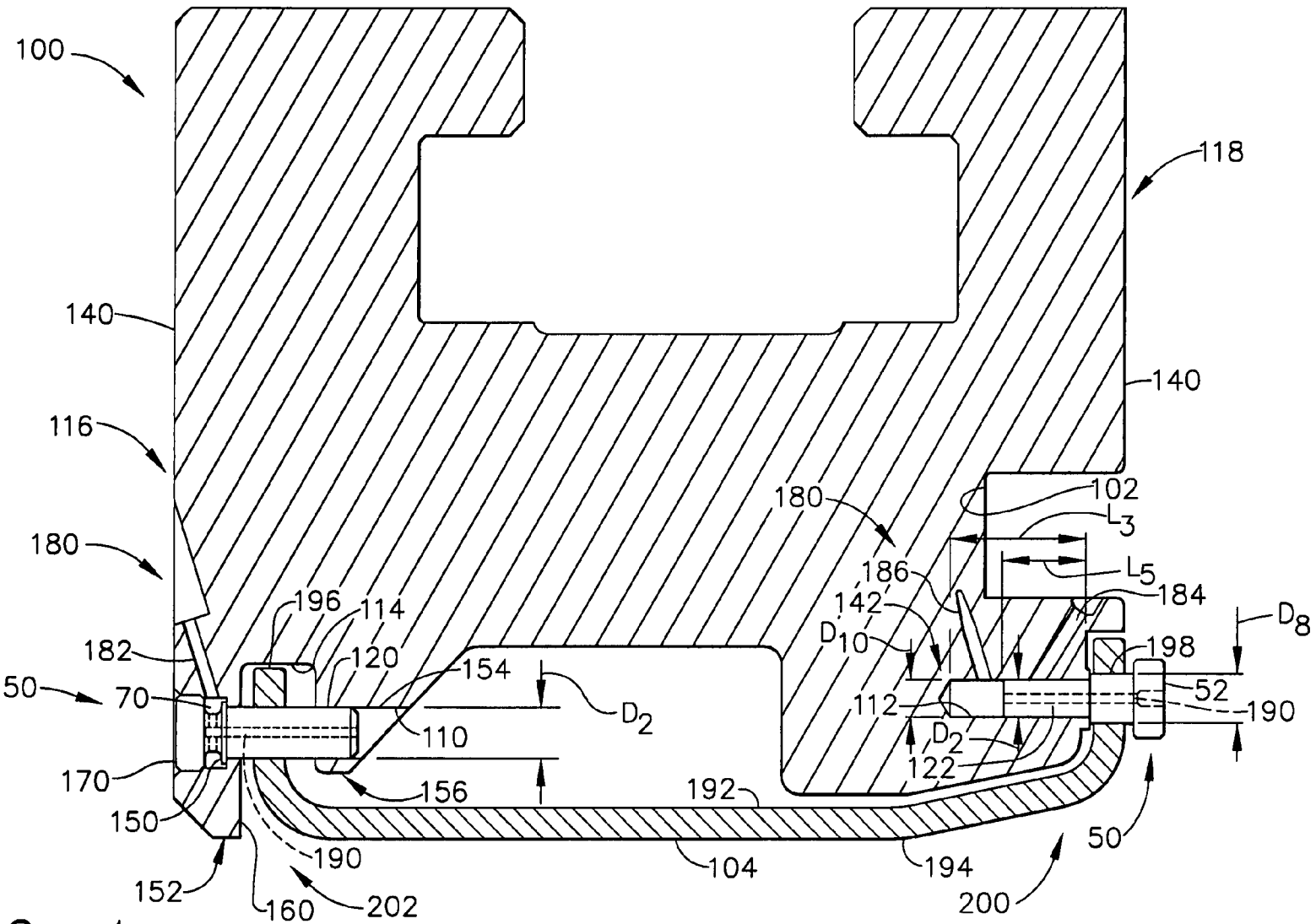
FIG. 4 is an enlarged cross-sectional view of a portion of a stator assembly that may be used with a turbine engine, such as the gas turbine engine shown in FIG. 1, and including the fastener shown in FIG. 2.
Figure 5:
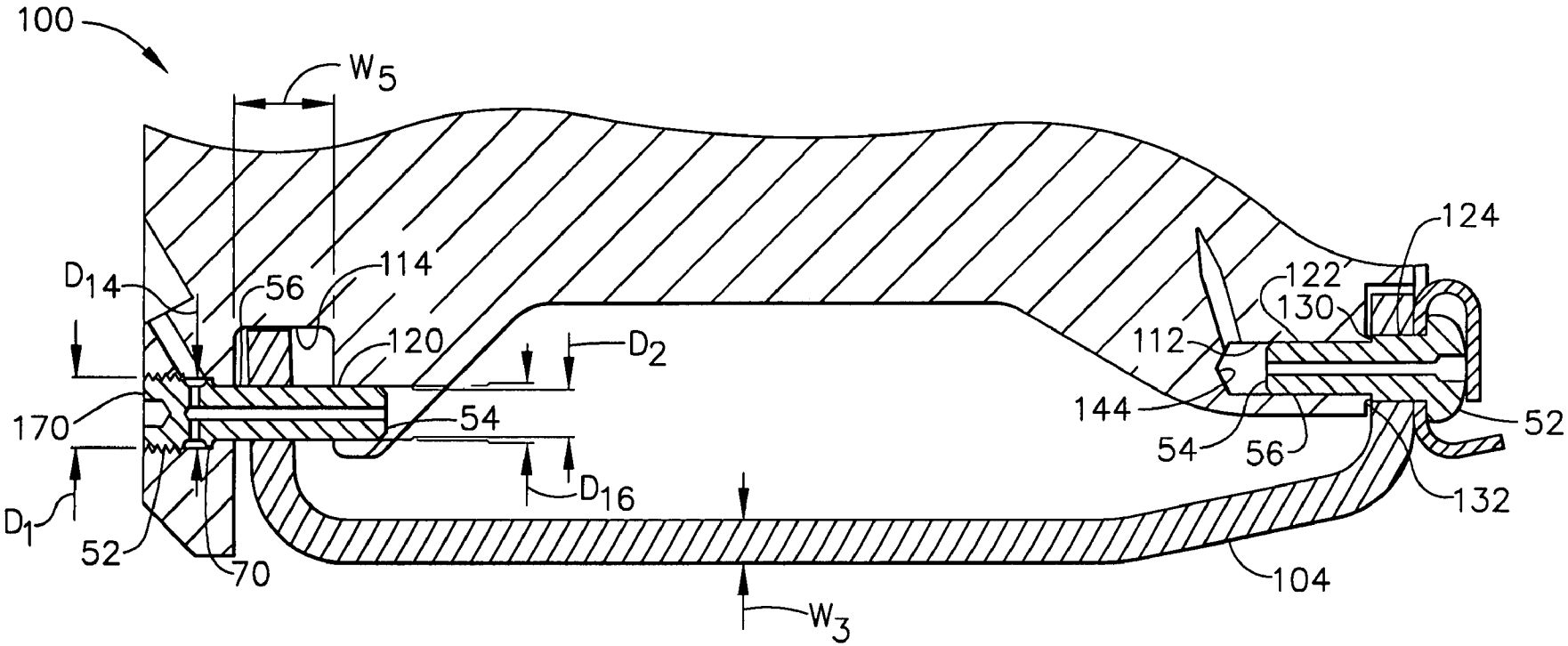
FIG. 5 is an enlarged cross-sectional schematic view of a portion of the stator assembly shown in FIG. 4.

FIG. 4 is an enlarged cross-sectional view of a portion of a stator assembly 100 that may be used with a turbine engine, such as gas turbine engine 10 (shown in FIG. 1). FIG. 5 is an enlarged cross-sectional schematic view of a portion of stator assembly 100. Specifically, stator assembly 100 includes a stator block 102 that forms a portion of a casing within engine 10, and a shroud 104. In one embodiment, stator casing 100 extends circumferentially around a rotor assembly, such as turbine 14.

In the exemplary embodiment, stator block 102 is fabricated from a metallic material and is formed with a plurality of leading edge fastener openings 110, a plurality of trailing edge fastener openings 112, and a shroud slot 114. Fastener openings 110 are circumferentially-spaced across a leading edge side 116 of stator block 102, and openings 112 are circumferentially-spaced across a trailing edge side 118 of stator block 102. Openings 110 and 112 are each sized to receive a fastener 50 therein to enable shroud 104 to be coupled to stator block 102, as described in more detail below.

In the exemplary embodiment, fasteners 50 include a plurality of pins 120 and a plurality of bolts 122. Pins and bolts 120 and 122, respectively, are substantially similar and each includes a wear or thermally insulating coating, internal cooling passageway 90, and head, nose, and barrel portions 52, 54, and 56, respectively. Unlike pins 120, threads 60 are not formed within bolt head portion 52, but rather instead each barrel portion 56 is threaded. In addition, bolt barrel portion 56 is stepped such that at least one segment 124 of barrel portion 56 has an external diameter $D_8$ that is sized differently than the remaining barrel portion diameter $D_2$. For example, in the exemplary embodiment, barrel portion diameter $D_8$ is larger than barrel portion diameter $D_2$.

A sealing face 130 is defined at the intersection created between barrel portion 56 and segment 124. Accordingly, in the exemplary embodiment, bolts 120 do not include sealing flange 70, but rather, when bolts 120 are fully secured within openings 112, sealing flange 70 is secured in sealing contact against stator block 102, and more specifically, against a sealing boss 132 extending outwardly from stator block 102. Each sealing boss 132 circumscribes each opening 112, and extends outwardly from stator block to form a mating surface that receives sealing face 130 in sealing contact.

Bolt cooling passageway 90 extends between inlet 94 and discharge outlet 96. However, unlike pins 120, bolt cooling passageway inlet 94 is defined within bolt barrel portion 56.

In the exemplary embodiment, each stator block opening 112 extends radially inward from an external surface 140 of stator block 102 and has a diameter $D_{10}$ that is substantially constant therethrough. More specifically, opening 112 has a length $L_3$ that is longer than a length $L_5$ of bolt barrel portion 56. Accordingly, when bolt 120 is threadedly coupled within opening 112, a hollow space 142 is defined between bolt inner end 64 and a radially inner end 144 of opening 112.

Each stator block opening 110 also extends radially inward from stator block external surface 140 and is bifurcated such that a first portion 150 of opening 110 is defined within a radially outer portion 152 of stator block 102 that is adjacent to shroud slot 114, and a second portion 154 of opening 110 is defined within a radially inner portion 156 of shroud block 102 that is adjacent to shroud slot 114. In the exemplary embodiment, opening first portion 150 has a diameter $D_{14}$ that is slightly larger than pin head diameter $D_1$, an opening second portion 154 has a diameter $D_{16}$ that is smaller than diameter $D_{14}$ and is slightly larger than pin barrel portion diameter $D_2$. More specifically, opening first portion 150 extends from external surface 140 to an end wall 160 that defines a portion of shroud slot 114, and opening second portion 152 extends through end wall 160 and through stator block radially inner portion 156. Accordingly, when pin 120 is securely coupled within opening 110, seal flange 70 contacts end wall 160 in sealing contact, and pin barrel portion 56 is inserted through opening portion 150 and at least partially through opening portion 152. Moreover, when pin 120 is securely coupled within opening 110, pin head 52 is recessed within opening 110 such that an outer surface 170 of pin head 52 is substantially co-planar with the portion of stator block external surface 140 adjacent to opening 110.

Each stator block opening 110 and 112 is coupled in flow communication to a cooling fluid supply source through a cooling circuit 180. Cooling circuit 180 includes a plurality of supply slots 182 that each supply cooling air into a respective opening 110, and a plurality of supply slots 184 that each supply cooling air into a respective opening 112. Cooling circuit 180 also includes a plurality of discharge slots 186 that each route discharged cooling air from a respective opening 112.

Shroud 104 includes a plurality of fastener openings 190 which extend from a radially inner side 192 of shroud 104 to a radially outer side 194 of shroud 104. More specifically, openings 190 include a plurality of fastener pin openings 196 that are sized to receive a portion of a respective pin 120 therethrough, and a plurality of bolt openings 198 that are sized to receive a portion of a respective bolt 122 therethrough. More specifically, openings 196 are sized to receive pin barrel portion 56 therethrough, and openings 198 are sized to receive pin barrel portions 54 and 124 therein such that head portion 52 remains external to opening 198.

When assembled, shroud 104 is suspended from pins and bolts 120 and 122, respectively. More specifically, when stator assembly 100 is fully assembled, a downstream side 200 of shroud 104 is coupled to stator block 102 by bolts 122 such that bolts 122 are inserted through shroud openings 198 prior to being threadingly coupled to stator block 102 within block openings 112. Accordingly, when bolts 122 are secured to block 102, shroud downstream side 200 is suspended from bolt barrel portion 124 between bolt head portion 52 and stator block external surface 140. Furthermore, when stator assembly 100 is fully assembled, an upstream side 202 of shroud 104 is coupled to stator block 102 by pins 120 such that shroud 104 is suspended by pin barrel portion 56 within shroud slot 114. Accordingly, when coupled to stator block 104, a radial clearance is defined between shroud 104 and rotating members of a rotor assembly, such as Shroud 104 is fabricated from a ceramic matrix composite (CMC) material that enables shroud 104 to be exposed to, and to sustain, higher operating temperatures than fasteners 50 or stator block 102. Accordingly, a rate of thermal expansion for shroud 104 may be different than a rate of thermal expansion of fasteners 50 or stator block 102 during engine operation. The pin and bolt concepts described herein, permit fasteners 50 to accommodate the difference in thermal expansion rates between stator block 102 and shroud 104. More specifically, because a width $W_3$ of shroud 104 is smaller than a width $W_5$ of shroud slot 114, shroud 104 may slide axially within slot 114 to accommodate differential thermal expansion such that a radial clearance defined between shroud 104 and a rotor assembly, such as turbine 14. Moreover, the pin and bolt concepts described herein also enable fasteners 50 to operate within the thermal environment sustained by ceramic matrix composites, without melting. Notably, the wear or thermal coating across fasteners 50 facilitates enabling the material used in fabricating fasteners 50 to operate beyond its un-coated melting point. Moreover, because the coating provides both thermal insulation and oxidation resistance, the coating facilitates extending a useful life of fasteners 50.

In addition, when fully assembled, cooling fluid is supplied internally to fasteners 50 during engine operation. Specifically, cooling fluid is supplied to stator block openings 110 through supply slots 182. As the fluid enters openings 110, annulus 80 is pressurized by the cooling fluid prior to the fluid being channeled into pin cooling passageway 90 through inlet 94. The cooling fluid flows through pin cooling passageway 90 and is discharged through outlet 96 and flows external to stator block 102. More specifically, the cooling fluid flowing through pin cooling passageway 90 facilitates maintaining an operating temperature of pin 120 within acceptable limits.

In addition, cooling fluid is supplied to stator block openings 112 through slots 184. Fluid supplied through slots 184 is channeled into bolt cooling passageway 90 through inlet 94. The cooling fluid flows through pin cooling passageway 90 and is discharged through bolt cooling passageway outlet 96 wherein the fluid enters space 142 prior to being discharged externally to stator block 102 through discharge slots 186. More specifically, the cooling fluid flowing through bolt cooling passageway 90 facilitates maintaining an operating temperature of bolt 122 within acceptable limits.

The above-described fasteners provide a cost-effective and highly reliable method for coupling a ceramic matrix composite shroud to a metallic stator block. Accordingly, the combination of the ceramic matrix composite shroud and the fasteners described herein, facilitate enabling the turbine to operate at higher temperatures, thus improving thermodynamic efficiency of the turbine. The fasteners described herein accommodate the differential thermal expansion between the shroud and the stator block, while maintaining the radial clearance defined by the shroud. As a result, the fasteners facilitate extending a useful life of the stator assembly and improving the operating efficiency of the gas turbine engine in a cost-effective and reliable manner.

Exemplary embodiments of stator assemblies and turbine engines are described above in detail. The stator assemblies are not limited to the specific embodiments described herein, but rather, components of each stator assembly may be utilized independently and separately from other components described herein. For example, each stator assembly component can also be used in combination with other turbine engine components, and is not limited to practice with only stator assembly 100 as described herein. Rather, the present invention can be implemented and utilized in connection with many other high temperature attachment configurations.

While the invention has been described in terms of various specific embodiments, those skilled in the art will recognize that the invention can be practiced with modification within the spirit and scope of the claims.

What is claimed is:

1. A method for assembling a stator assembly for a turbine engine, said method comprising:

positioning a shroud fabricated from a ceramic matrix composite material adjacent to a metallic stator block; and coupling the shroud to the stator block using a coupling arrangement such that a predetermined radial clearance is defined between the shroud and a rotor assembly coupled radially inward thereof, wherein the coupling arrangement includes at least one fastener that includes a head portion, a nose portion, a barrel portion extending between the head and nose portions, and a sealing flange that extends radially outward from the barrel portion.

2. A method in accordance with claim 1 wherein coupling the shroud to the stator block further comprises coupling the shroud to the stator block using at least one fastener that extends through a pre-formed opening in the stator block and through a pre-formed opening in the shroud.

3. A method in accordance with claim 1 wherein coupling the shroud to the stator block further comprises coupling the shroud to the stator block such that the fastener sealing flange contacts the stator block to facilitate preventing leakage between the shroud and the stator block.

4. A method in accordance with claim 1 wherein coupling the shroud to the stator block further comprises coupling the shroud to the stator block such that the fastener sealing flange contacts the stator block such that during engine operation, a pressurized annulus is defined circumferentially around the at least one fastener, between the sealing flange and the head portion.

5. A method in accordance with claim 1 wherein coupling the shroud to the stator block further comprises coupling the shroud to the stator block such that during engine operation, the fastener sealing flange accommodates differential thermal growth between the stator block and the shroud.

6. A method in accordance with claim 1 wherein coupling the shroud to the stator block further comprises coupling the shroud to the stator block using at least one fastener that includes a tapered nose portion, such that the nose portion has a substantially bullnose-shaped cross-sectional profile.

7. A method in accordance with claim 1 wherein coupling the shroud to the stator block further comprises coupling the shroud to the stator block using at least one fastener that is coated with at least one of a wear coating and a thermal barrier coating.

8. A method in accordance with claim 1 wherein coupling the shroud to the stator block further comprises coupling the shroud to the stator block using at least one fastener that is coated with a coating that facilitates reducing oxidation of said at least one fastener.

9. A method in accordance with claim 1 wherein coupling the shroud to the stator block further comprises coupling the shroud to the stator block using at least one fastener that includes a cooling passageway formed therein for reducing an operating temperature of the at least one fastener.

10. A method in accordance with claim 9 wherein coupling the shroud to the stator block further comprises coupling the shroud to the stator block using at least one fastener that includes an external surface and an opening that extends from the external surface to the cooling passageway for channeling cooling fluid into the cooling passageway during engine operation.

11. A method in accordance with claim 9 wherein coupling the shroud to the stator block further comprises coupling the shroud to the stator block using at least one fastener that includes an external surface and an opening that extends from the external surface to the cooling passageway, wherein the opening is substantially concentrically aligned with respect to an axis of symmetry extending through the at least one fastener, and wherein the opening is for discharging cooling fluid from the cooling passageway during engine operation.

12. A stator assembly for a turbine engine, said stator assembly comprising:

a stator block comprising at least one fastener opening;

a coupling arrangement; and a shroud coupled to said stator block by said coupling arrangement, said shroud comprising at least one fastener opening, said coupling arrangement comprising at least one fastener extending through said shroud at least one fastener opening and through said stator block at least one fastener opening, said at least one fastener comprising an external surface coated with at least one of a wear coating and a thermal barrier coating, said at least one fastener further comprising a head portion, a nose portion, and a barrel portion extending therebetween, said nose portion comprises a bullnose-shaped cross-sectional profile.

13. A stator assembly in accordance with claim 12 wherein said fastener coating facilitates thermally insulating said at least one fastener.

14. A stator assembly in accordance with claim 12 wherein said fastener coating facilitates reducing oxidation of said at least one fastener.

15. A stator assembly in accordance with claim 12 wherein said at least one fastener comprises at least a head portion, a barrel portion, and a nose portion, said barrel portion between said head and nose portions, at least one of said head and barrel portions comprises a plurality of threads.

16. A stator assembly in accordance with claim 12 wherein said nose portion facilitates improving adhesion of said at least one of a wear coating and a thermal barrier coating.

17. A stator assembly in accordance with claim 12 wherein said at least one fastener comprises a head portion, a nose portion, and a barrel portion extending therebetween, at least one of said nose portion and said barrel portion defines a cooling circuit therein.

18. A stator assembly in accordance with claim 17 wherein said fastener further comprises an opening extending from said external surface to said cooling circuit, said opening defined within said barrel portion for supplying cooling fluid into said cooling circuit.

19. A stator assembly in accordance with claim 17 wherein said cooling circuit extends through said barrel portion and said nose portion, said nose portion defines an opening therein for discharging cooling fluid from said cooling circuit.

20. A stator assembly in accordance with claim 17 further comprising a sealing flange extending substantially radially outward from at least one of said head portion and said barrel portion, said sealing flange contacts a portion of said stator assembly to define a pressurized annulus extending circumferentially around said at least one fastener.

21. A stator assembly in accordance with claim 20 wherein said sealing flange facilitates sealing between at least a portion of said stator block and said shroud.

22. A stator assembly in accordance with claim 20 wherein said sealing flange extends circumferentially around, and is formed integrally with, said at least one fastener.

23. A stator assembly in accordance with claim 20 wherein said sealing flange accommodates differential thermal growth between said shroud and said stator block.

24. A stator assembly in accordance with claim 12 wherein at least one of said shroud and said at least one fastener is fabricated from a ceramic matrix composite material.

25. A turbine engine comprising:

a rotor assembly; and a stator assembly comprising a stator block, at least one fastener, and a shroud, said shroud coupled to said stator block by said at least one fastener such that a clearance is defined between at least a portion of said rotor assembly and said shroud, at least one of said stator block and said shroud is fabricated from a ceramic matrix composite material, said at least one fastener comprising an external surface coated with at least one of a wear coating and a thermal barrier coating, said at least one fastener further comprises a cooling passageway extending at least partially therethrough.

26. A turbine engine in accordance with claim 25 wherein said stator assembly at least one fastener comprises a head portion, a barrel portion, and a nose portion, said barrel portion extending between said head and nose portions, at least one of said head and barrel portions comprises a plurality of threads.

27. A turbine engine in accordance with claim 26 wherein said at least one fastener nose portion comprises a bullnose-shaped cross-sectional profile.

28. A turbine engine in accordance with claim 26 wherein said nose portion facilitates improved adhesion of said external surface coating.

29. A turbine engine in accordance with claim 25 wherein said at least one fastener further comprises an external surface and at least one opening extending from said external surface to said cooling passageway, said at least one opening for channeling cooling fluid into said cooling passageway.

30. A turbine engine in accordance with claim 25 wherein said at least one fastener further comprises a centerline axis of symmetry, an external surface, and at least one opening extending from said external surface to said cooling passageway, said opening substantially concentrically aligned with respect to said centerline axis of symmetry for discharging cooling fluid from said cooling passageway.

31. A turbine engine in accordance with claim 30 wherein said cooling passageway is substantially concentrically aligned with respect to said at least one fastener.

32. A turbine engine in accordance with claim 26 wherein said stator assembly at least one fastener further comprises a sealing flange extending radially outward from said at least one fastener, said sealing flange configured to contact a portion of said stator assembly such that a pressurized annulus is defined substantially circumferentially around said at least one fastener.

33. A turbine engine in accordance with claim 32 wherein said sealing flange is further configured to contact said stator assembly in sealing contact to facilitate preventing leakage between said stator block and said shroud.

34. A turbine engine in accordance with claim 32 wherein said sealing flange is formed integrally with said at least one fastener.

35. A turbine engine in accordance with claim 32 wherein said sealing flange accommodates differential thermal growth between said shroud and said stator block.

36. A turbine engine in accordance with claim 26 wherein said stator assembly fastener coating is configured to thermally insulate said at least one fastener.

37. A turbine engine in accordance with claim 26 wherein said stator assembly fastener coating is configured to facilitate reducing oxidation of said at least one fastener.

38. A stator assembly for a turbine engine, said stator assembly comprising:

a stator block comprising at least one fastener opening;

a coupling arrangement; and a shroud coupled to said stator block by said coupling arrangement, said shroud comprising at least one fastener opening, said coupling arrangement comprising at least one fastener extending through said shroud at least one fastener opening and through said stator block at least one fastener opening, said shroud fabricated from a ceramic matrix composite material, said at least one fastener comprises a head portion, a nose portion, and a barrel portion extending therebetween, said at least one fastener further comprises a seal flange extending radially outward from said barrel portion.

39. A stator assembly in accordance with claim 38 wherein said seal flange contacts said stator block such that a pressurized annulus is defined between said seal flange and said at least one fastener head portion.

40. A stator assembly in accordance with claim 38 wherein said seal flange accommodates differential thermal growth between said shroud and said stator block.

41. A stator assembly in accordance with claim 38 wherein said seal flange is configured to facilitate preventing flow leakage between said stator block and said shroud.

42. A stator assembly in accordance with claim 38 wherein said seal flange is fabricated integrally with said at least one fastener.

43. A stator assembly in accordance with claim 38 wherein said nose portion is tapered with a bullnose-shaped cross-sectional profile.

44. A stator assembly in accordance with claim 38 wherein said at least one fastener is coated with at least one of a wear coating and a thermal barrier coating.

45. A stator assembly in accordance with claim 38 wherein said at least one fastener is coated with a coating that facilitates reducing oxidation of said at least one fastener.

46. A stator assembly in accordance with claim 38 wherein said at least one fastener further comprises a centerline axis of symmetry and a cooling passageway extending through a portion of said at least one fastener, said cooling passageway is substantially concentrically aligned within said at least one fastener.

47. A stator assembly in accordance with claim 46 wherein said at least one fastener further comprises an external surface and at least one opening extending from said external surface to said cooling passageway, said at least one opening for channeling cooling fluid into said cooling passageway.

48. A stator assembly in accordance with claim 46 wherein said at least one fastener further comprises an external surface and at least one opening extending from said external surface to said cooling passageway, said at least one opening is substantially concentrically aligned with respect to said at least one fastener and is for discharging cooling fluid from said cooling passageway.

* * * * *